US008388808B2

(12) United States Patent
Heijnesson-Hulten et al.

(10) Patent No.: US 8,388,808 B2
(45) Date of Patent: Mar. 5, 2013

(54) CELLULOSIC PRODUCT

(75) Inventors: Anette Monica Heijnesson-Hulten, Lerum (SE); Fredrik Solhage, Boras (SE); John Sandstrom, Stora Hoga (SE)

(73) Assignee: Akzo Nobel N.V., Arnhem (NL)

( * ) Notice: Subject to any disclaimer, the term of this patent is extended or adjusted under 35 U.S.C. 154(b) by 0 days.

(21) Appl. No.: 12/999,519

(22) PCT Filed: Jun. 15, 2009

(86) PCT No.: PCT/EP2009/057322

§ 371 (c)(1), (2), (4) Date: Dec. 16, 2010

(87) PCT Pub. No.: WO2009/153225

PCT Pub. Date: Dec. 23, 2009

(65) Prior Publication Data

US 2011/0088860 A1 Apr. 21, 2011

Related U.S. Application Data

(60) Provisional application No. 61/073,149, filed on Jun. 17, 2008.

(30) Foreign Application Priority Data

Jun. 17, 2008 (EP) ..... 08158391

(51) Int. Cl.
*D21H 11/00* (2006.01)

(52) U.S. Cl. ..... 162/164.1

(58) Field of Classification Search ..... 162/164.1, 162/27, 76, 187, 158; 524/27
See application file for complete search history.

(56) References Cited

U.S. PATENT DOCUMENTS

| | | | |
|---|---|---|---|
| 3,615,972 | A | 10/1971 | Morehouse et al. |
| 3,945,956 | A | 3/1976 | Garner |
| 4,287,308 | A | 9/1981 | Nakayama et al. |
| 5,536,756 | A | 7/1996 | Kida et al. |
| 5,964,983 | A | 10/1999 | Dinand et al. |
| 6,183,596 | B1 | 2/2001 | Matsuda et al. |
| 6,235,394 | B1 | 5/2001 | Shimazawa et al. |
| 6,235,800 | B1 | 5/2001 | Kyuno et al. |
| 6,509,384 | B2 | 1/2003 | Kron et al. |
| 6,902,649 | B1 | 6/2005 | Satyavolu et al. |
| 2001/0038893 | A1 | 11/2001 | Mohan et al. |
| 2005/0079352 | A1 | 4/2005 | Glorioso et al. |
| 2006/0135676 | A1 | 6/2006 | Greenwood et al. |
| 2010/0024998 | A1 | 2/2010 | Wildlock et al. |
| 2010/0112351 | A1 | 5/2010 | Heijnesson-Hulten |

FOREIGN PATENT DOCUMENTS

| | | |
|---|---|---|
| EP | 0 102 335 | 3/1984 |
| EP | 486080 | 1/1996 |
| EP | 1288272 | 3/2003 |
| GB | 2 066 145 | 7/1981 |
| JP | 1987-286534 | 12/1987 |
| JP | 10-0292281 | 11/1998 |
| JP | 2005-272633 | 6/2005 |
| JP | 2005-213379 | 8/2005 |
| JP | 2005-223806 | 8/2005 |
| WO | 00/14333 | 3/2000 |
| WO | 2004/072160 | 8/2004 |
| WO | 2004/113613 | 12/2004 |
| WO | 2006/065196 | 6/2006 |
| WO | 2006/068573 | 6/2006 |
| WO | 2007/091960 | 8/2007 |
| WO | 2007/091961 | 8/2007 |

OTHER PUBLICATIONS

International Preliminary Report on Patentability, PCT/EP2009/057322, mailed Oct. 22, 2010, 9 pages.
International Search Report and Written Opinion, PCT/EP2009/057322, mailed Oct. 1, 2009, 16 pages.
Japanese Office Action for Patent Application No. 2011-514005, Drafted Jul. 6, 2012, Mailed Jul. 10, 2012, English language translation provided.

*Primary Examiner* — Mark Halpern
(74) *Attorney, Agent, or Firm* — Kenyon & Kenyon LLP

(57) ABSTRACT

The present invention relates to a process of producing a cellulosic product comprising (i) providing an aqueous suspension of cellulosic fibers, (ii) adding microfibrillar polysaccharide, (iii) adding thermoplastic microspheres, (iv) dewatering the suspension and forming a cellulosic product. The invention also relates to a process of producing a single layer cellulosic product comprising (i) providing an aqueous suspension of cellulosic fibers, (ii) adding microfibrillar polysaccharide derived from softwood and/or hardwood and optionally adding thermoplastic microspheres to the suspension, (iii) dewatering the suspension and forming a cellulosic product. The invention further relates to a cellulosic product obtainable from said processes. The invention also relates to a composition comprising microfibrillar polysaccharide and thermoplastic microspheres and the use thereof.

9 Claims, No Drawings

CELLULOSIC PRODUCT

REFERENCE TO RELATED APPLICATION(s)

This application is a 371 of PCT/EP09/57322 filed on Jun. 15, 2009 and claims the benefit of U.S. Provisional Application No. 61/073,149 filed on Jun. 17, 2008.

The present invention relates to a process of producing a cellulosic product, such as a single layer cellulosic product and a composition suitable for addition to a cellulosic suspension. The invention also relates to a cellulosic product obtainable by the process, and the use of said cellulosic product.

BACKGROUND OF THE INVENTION

Today, the development within the papermaking industry is focused on reducing the grammage of cellulosic products such as board products while increasing or substantially maintaining their further properties including strength properties.

WO 00/14333 relates to a method in which latex is used as a binder in the bulk layer to improve strength properties. However, WO 00/14333 suffers from high amounts of chemicals needed as well as problems related to the application of the latex binder. As an example, if latex is added to the wet end, retention problems of the latex on the fibers may cause deposit problems as well as disturbance of the wet end chemistry balance. Application problems may also occur if latex were added to already formed paper or board layers using existing equipment. Latex may also result in repulpability problems.

U.S. Pat. No. 6,902,649 discloses a seed-based enhanced fiber additive (EFA) derived from non-wood which may be used in papermaking. U.S. Pat. No. 6,902,649 states that EFA used as a fiber replacement material can maintain or increase paper strength properties in applications whereby the basis weight of the paper is decreased.

One object of the instant invention is to provide a new process of producing a cellulosic product, especially a single layer cellulosic product, substantially maintaining and/or increasing its properties including strength properties such as tensile strength while using a smaller quantity of cellulosic material so as to reduce the grammage of the formed cellulosic sheets. Yet a further object of the invention is to provide a cellulosic product, especially a single layer cellulosic product, in which at least one property of the cellulosic product including tensile strength, Z-strength, and/or other strength is improved or substantially maintained while the bending resistance can be substantially maintained or increased. A further object of the instant invention is to provide a composition which may be used as a premix to provide such cellulosic product.

THE INVENTION

The present invention relates to a process of producing a cellulosic product comprising (i) providing an aqueous suspension of cellulosic fibers, (ii) adding microfibrillar polysaccharide, (iii) adding thermoplastic microspheres, and (iv) dewatering the suspension and forming a cellulosic product.

The present invention also relates to a process of producing a single layer cellulosic product comprising (i) providing an aqueous suspension of cellulosic fibers, (ii) adding microfibrillar polysaccharide derived from softwood and/or hardwood and optionally adding thermoplastic microspheres to the suspension (iii) dewatering the suspension and forming a single layer cellulosic product.

The term "cellulosic product", as used herein, includes inter alia pulp bales and cellulosic products in sheet and web form such as paper, paperboard, and board. The cellulosic product may comprise one or several layers containing cellulosic fibers.

The term "cellulosic product" as used herein, includes e.g. paperboard comprising cellulosic fibers and solid board, e.g. solid bleached sulfate board (SBS) including boards (composed of one or several layers of bleached chemical pulp) coated on the top and optionally on the backside; solid unbleached sulfate board (SUS) and solid unbleached board (SUB) which may be made from unbleached chemical pulp (often coated on the top and sometimes on the backside which can be composed of several layers of unbleached chemical pulp in the board); carton board, e.g. folding boxboard (FBB) which may be made with a middle layer of mechanical pulp between layers of bleached or unbleached chemical pulp (usually coated on the top side and being a low density board with high bending stiffness), folding carton board, liquid packaging board (LPB) including aseptic, non-aseptic packaging and retortable boards; white lined chipboard (WLC) (which may comprise middle layers of different types of recycled fibers and a top layer usually made from chemical pulp); fluting and corrugated fluting, unbleached kraftboard, grey chipboard and recycled board; liner, liner board and container board, cup board, fully bleached or unbleached kraftliner, testliner, unbleached kraftliner, unbleached testliner and recycled liner such as OCC, White Top Liner consisting of a back layer made from unbleached chemical pulp or brown recycled fibers and a top layer made from bleached chemical pulp, sometimes including filler such as GCC and PCC; Gypsum board, Core board, Solid fiber board, the inner layers thereof usually consisting of recycled fibers and the outer layers of paper with high tensile strength; sack paper, and wrapping paper.

According to one embodiment, the invention provides a cellulosic product such as single layer cellulosic product comprising microfibrillar polysaccharide and optionally thermoplastic microspheres distributed throughout the cellulosic product, e.g. substantially uniformly distributed throughout the cellulosic product. According to one embodiment, the single layer cellulosic product may be coated or laminated with any number of non-cellulosic coating or layer, e.g. polymer films, metallized films, barrier layers as further disclosed herein.

By the term "microfibrillar polysaccharide" is meant to include species derived from polysaccharide without limitation including cellulose, hemicellulose, chitin, chitosan, guar gum, pectin, alginate, agar, xanthan, starch, amylose, amylopectin, alternan, gellan, mutan, dextran, pullulan, fructan, locust bean gum, carrageenan, glycogen, glycosaminoglycans, murein, bacterial capsular polysaccharides, and derivatives thereof.

According to one embodiment, the microfibrillar polysaccharide is microfibrillar cellulose which would be the most commonly selected microfibrillar polysaccharide and will therefore be described more in detail herein. Sources of cellulose for the preparation of microfibrillar cellulose include the following: (a) wood fibers, e.g. derived from hardwood and softwood, such as from chemical pulps, mechanical pulps, thermal mechanical pulps, chemical-thermal mechanical pulps, recycled fibers, (b) seed fibers, such as from cotton; (c) seed hull fiber, such as from soybean hulls, pea hulls, corn hulls; (d) bast fibers, such as from flax, hemp, jute, ramie, kenaf, (e) leaf fibers, such as from manila hemp, sisal hemp;

(f) stalk or straw fibers, such as from bagasse, corn, wheat; (g) grass fibers, such as from bamboo; (h) cellulose fibers from algae, such as velonia; (i) bacteria or fungi; and (j) parenchymal cells, such as from vegetables and fruits, and in particular sugar beets, and citrus fruits such as lemons, limes, oranges, grapefruits. Microcrystalline forms of these cellulose materials may also be used. Cellulose sources include (1) purified, optionally bleached, wood pulps produced from sulfite, kraft (sulfate), or prehydrolyzed kraft pulping processes and (2) purified cotton linters. The source of the cellulose is not limiting, and any source may be used including synthetic cellulose or cellulose analogs. According to one embodiment, the microfibrillar polysaccharide such as microfibrillar cellulose is derived from hardwood and/or softwood.

For purposes of the present invention polysaccharide microfibrils refer to small diameter, high length-to-diameter ratio substructures which are comparable in dimensions to those of cellulose microfibrils occurring in nature. While the present specification refers to microfibrils and microfibrillation, these terms are here also meant to include (nano) fibrils with nanometer dimensions (cellulosic or other).

According to one embodiment, the microfibrillar polysaccharide, e.g. microfibrillar cellulose, is modified e.g. by means of grafting, cross-linking, chemical oxidation, for example by use of hydrogen peroxide, Fenton's reaction, and/or Tempo; physical modification such as adsorption, e.g. chemical adsorption; and enzymatic modification. Combined technologies may also be used to modify microfibrillar cellulose.

Cellulose can be found in nature in several hierarchical levels of organization and orientation. Cellulose fibers comprise a layered secondary wall structure within which macrofibrils are arranged. Macrofibrils comprise multiple microfibrils which further comprise cellulose molecules arranged in crystalline and amorphous regions. Cellulose microfibrils range in diameter from about 5 to about 100 nanometers for different species of plant, and are most typically in the range from about 25 to about 35 nanometers in diameter. The microfibrils are present in bundles which run in parallel within a matrix of amorphous hemicelluloses (specifically xyloglucans), pectinic polysaccharides, lignins, and hydroxyproline rich glycoproteins (includes extensin). Microfibrils are spaced approximately 3-4 nm apart with the space occupied by the matrix compounds listed above.

According to one embodiment, the polysaccharide is refined or delaminated to such an extent that the final specific surface area (determined by adsorption of $N_2$ at 177 K according to the BET method using a Micromeritics ASAP 2010 instrument) of the formed microfibrillar polysaccharide is from about 1 to about 100, such as from about 1.5 to about 15, or from about 3 to about 10 $m^2/g$. The viscosity of the obtained aqueous suspension of microfibrillar polysaccharide can be from about 200 to about 4000, or from about 500 to about 3000, or from about 800 to about 2500 mPas. The stability, which is a measure of the degree of sedimentation of the suspension, can be from about 60 to 100, such as from about 80 to about 100%, where 100% indicates no sedimentation for a period of at least 6 months.

According to one embodiment, the microfibrillar polysaccharide has an arithmetic fiber length from about 0.05 to about 0.5, for example from about 0.1 to about 0.4, or from about 0.15 to about 0.3 mm. According to one embodiment, the microfibrillar polysaccharide is added to the cellulosic suspension in an amount of from about 0.1 to about 50, for example from about 0.5 to about 30, such as from about 1 to about 25 or from about 1 to about 15 or from about 1 to about 10 wt % based on the weight of the cellulosic product.

Non-delaminated wood fibers, e.g. cellulose fibers, are distinct from microfibrillar fibers because the fiber length of non-delaminated wood fibers ranges usually from about 0.7 to about 3 mm. The specific surface area of cellulosic fibers usually ranges from about 0.5 to about 1.5 $m^2/g$. Delamination can be carried out in various devices suitable for delaminating the fibers of the polysaccharides. The prerequisite for the processing of the fibers is that the device is controlled in such way that fibrils are released from the fiberwalls. This may be accomplished by rubbing the fibers against each other, the walls or other parts of the device in which the delamination takes place. According to one embodiment, the delamination is accomplished by means of pumping, mixing, heat, steam explosion, pressurization-depressurization cycle, impact grinding, ultrasound, microwave explosion, milling, and combinations thereof. In any of the mechanical operations disclosed herein, it is important that sufficient energy is applied to provide microfibrillar polysaccharide as defined herein.

According to one embodiment, the thermoplastic microspheres are expanded and added as pre-expanded microspheres or as unexpanded thermally expandable microspheres that preferably are expanded by heating during the cellulosic product production process, for example during a drying stage where heat is applied, or in a separate process step, for example in a cylinder heater or laminator. The microspheres may be expanded when the cellulosic product still is wet or when it is fully or almost fully dried. The microspheres are preferably added in the form of an aqueous slurry thereof, that optionally may contain other additives desirable to supply to the stock. The amount of thermoplastic microspheres added can be for example from about 0.01 to about 10, such as from about 0.05 to about 10, for example from about 0.1 to about 10, from about 0.1 to about 5, or from about 0.4 to about 4 wt % based on the weight of cellulosic product.

According to one embodiment, thermally expandable thermoplastic microspheres as referred to herein comprise a thermoplastic polymer shell encapsulating a propellant. The propellant is preferably a liquid having a boiling temperature not higher than the softening temperature of the thermoplastic polymer shell. Upon heating, the propellant increases the internal pressure at the same time as the shell softens resulting in significant expansion of the microspheres. Both expandable and pre-expanded thermoplastic microspheres are commercially available under the trademark Expancel® (Akzo Nobel) and are marketed in various forms, e.g. as dry free flowing particles, as an aqueous slurry or as a partially dewatered wet-cake. They are also well described in the literature, for example in U.S. Pat. Nos. 3,615,972, 3,945,956, 4,287,308, 5,536,756, 6,235,800, 6,235,394 and 6,509,384, in US Patent Applications Publication 2005/0079352, in EP 486080 and EP 1288272, in WO 2004/072160, WO 2007/091960 and WO 2007/091961 and in JP Laid Open No. 1987-286534, 2005-213379 and 2005-272633.

According to one embodiment, the thermoplastic polymer shell of the thermoplastic microspheres is preferably made of a homo- or co-polymer obtained by polymerising unsaturated monomers. Those monomers can, for example, be nitrile containing monomers such as acrylonitrile, methacrylonitrile, α-chloroacrylonitrile, α-ethoxyacrylonitrile, fumaronitrile or crotonitrile; acrylic esters such as methyl acrylate or ethyl acrylate; methacrylic esters such as methyl methacrylate, isobornyl methacrylate or ethyl methacrylate; vinyl halides such as vinyl chloride; vinyl esters such as vinyl acetate, vinyl ethers such as alkyl vinyl ethers like methyl vinyl ether or ethyl vinyl ether, other vinyl monomers such as vinyl pyridine; vinylidene halides such as vinylidene chloride; styrenes such as styrene, halogenated styrenes or α-methyl styrene; or dienes such as butadiene, isoprene and chloroprene. Any mixtures of the above mentioned monomers may also be used.

According to one embodiment, the propellant of the thermoplastic microspheres comprises hydrocarbons such as propane, butane, isobutane, n-pentane, isopentane, neopentane, hexane, isohexane, neohexane, heptane, isoheptane, octane or isooctane, or mixtures thereof. Aside from them, other hydrocarbon types can also be used, such as petroleum ether, or chlorinated or fluorinated hydrocarbons, such as methyl chloride, methylene chloride, dichloroethane, dichloroethylene, trichloroethane, trichloroethylene, trichlorofluoromethane, perfluorinated hydrocarbons, etc.

According to one embodiment, the expandable thermoplastic microspheres suitable for the invention have a volume median diameter from about 1 to about 500 μm, for example from about 5 to about 100 μm, or from about 10 to about 50 μm. The temperature at which the expansion starts, referred to as $T_{start}$, is preferably from about 60 to about 150° C., most preferably from about 70 to about 100° C. The temperature at which maximum expansion is reached, referred to as $T_{max}$, is preferably from about 90 to about 180° C., most preferably from about 115 to about 150° C.

According to one embodiment, pre-expanded thermoplastic microspheres suitable for the invention have a volume median diameter from about 10 to about 120 μm, most preferably from about 20 to about 80 μm. The density is preferably from about 5 to about 150 g/dm$^3$, most preferably from about 10 to about 100 g/dm$^3$. Even though pre-expanded thermoplastic microspheres are commercially available as such, it is also possible to provide them by thermal on-site expansion of unexpanded expandable thermoplastic microspheres, for example just before they are added to the stock, which is facilitated if the expandable microspheres have a $T_{start}$ below about 100° C. so steam can be used as a heating medium.

According to one embodiment, the weight ratio of microfibrillar polysaccharide to thermoplastic microspheres added to the aqueous suspension ranges from about 1:100 to about 200:1, for example from about 1:20 to about 40:1 or from about 1:5 to about 20:1 or from about 1:2 to about 10:1 or from about 1:1 to about 8:1 or from about 2:1 to about 5:1. According to one embodiment, the microfibrillar polysaccharide and the thermoplastic microspheres are added separately in any order. According to one embodiment, microfibrillar polysaccharide and thermoplastic microspheres are added as a premix. According to one embodiment, the premix further comprises at least one polyelectrolyte, such as a cationic polyelectrolyte.

According to one embodiment, the cellulosic product is a laminate. By the term "laminate" is meant a cellulosic product comprising at least two layers of paper and/or board. However, the laminate may also contain further layers of other material than paper and/or board including films of various polymers, e.g. polyethylene, polypropylene, polyester, polyvinyl and/or polyvinylidene chloride, polyvinyl alcohol (PVOH), polyethylene vinyl alcohol co-polymer, ethylene vinyl acetate co-polymers and cellulose esters in one or more layers and/or a metallic layer, e.g. an aluminum film, $SiO_x$-(where $0<x<=2$)) deposited polymer films, silica-blended polyvinyl alcohol (PVOH) as further disclosed in US2006/135676 or metallized polymer film which may function as barrier for gases and which may have low or no permeability to water, steam, carbon dioxide, and oxygen. Examples of suitable oxygen barriers include ethylene vinyl alcohol (EVOH), polyvinylidene chloride (PVDC), PAN (polyacrylo nitrile), aluminum, metallized films, e.g. of polypropylene or polyethylene terephthalate, $SiO_x$-deposited films (where $0<x<=2$), inorganic plate-shaped mineral compounded polymers such as clay compounded polymers.

According to one embodiment, the laminate is a packaging laminate comprising at least one cellulosic layer, at least one liquid barrier layer and at least one gas barrier layer, said paper or paperboard comprising, preferably at least at the edges thereof, expanded or unexpanded expandable thermoplastic microspheres.

According to one embodiment, the cellulosic product is a liquid packaging laminate comprising three layers paper or paperboard, of which preferably at least the middle layer comprises microfibrillar polysaccharide and/or thermoplastic microspheres.

According to one embodiment, the packaging laminate comprises at least one, preferably at least two liquid barrier layers on each side of the paper or paperboard base layer(s). A liquid barrier layer may be made of any material that show no or insignificant permeability to water. Suitable materials include polymers of polyethylene like high density or linear low density polyethylene, polypropylene, PVC, polyesters like polyethylene terephthalate, and physical or mechanical mixtures thereof. Also co-polymers can be used, such as co-polymers of ethylene and propylene. The liquid barrier layer(s) can be applied in any known ways, such as various lamination methods or the like.

According to one embodiment, the packaging laminate may further comprise a gas barrier layer, preferably between a base layer and a liquid non-permeable layer intended to face the inside of the package. Any material that show no or insignificant permeability to molecular oxygen can be used. Examples of materials include metal foils like aluminium foils, silica coating, e.g. applied in a coating composition comprising colloidal silica and optionally various additives as described in WO 2006/065196, or produced by plasma deposition. Other possible materials include polymers like polyvinyl alcohol or co-polymers of ethylene and vinyl alcohol. A gas barrier layer can be applied in any known way, such as various laminating methods or the like.

According to one embodiment, the invention concerns a process for the production of a packaging laminate comprising a step of appying least one liquid barrier layer and at least one gas barrier layer to a sheet or web of paper or paperboard comprising, preferably at least at the edges thereof, expanded or unexpanded expandable thermoplastic microspheres.

According to one embodiment, the cellulosic product is a sealed package for food or beverage products made of a packaging laminate comprising at least one base layer of paper or paperboard and at least one liquid barrier layer, and preferably at least one gas barrier layer, said paper or paperboard comprising, preferably at least at the edges thereof, expanded or unexpanded expandable thermoplastic microspheres.

According to one embodiment, in a single layer cellulosic product, the grammage is from about 40 to about 1500 g/m$^2$, such as from about 60 to about 700 or from about 80 to about 600, such as from about 90 to about 500 or from about 100 to about 500 g/m$^2$. The density is preferably from about 100 to about 1200 such as from about 150 to about 1000 or from about 200 to about 800 kg/m$^3$.

According to one embodiment, in a cellulosic product of two layer board the grammage, per layer, is from about 25 to about 750 g/m$^2$, such as from about 50 to about 400 or from about 100 to about 300 g/m$^2$. The density of two layers is preferably from about 300 to about 1200 kg/m$^3$, most preferably from about 400 to about 1000 kg/m$^3$ or from about 450 to about 900 kg/m$^3$. The total grammage is preferably from about 50 to about 1500 g/m$^2$, most preferably from about 100 to about 800 or from about 200 to about 600 g/m$^2$. The total density is preferably from about 300 to about 1200 kg/m$^3$, most preferably from about 400 to about 1000 kg/m$^3$ or from about 450 to about 900 kg/m$^3$.

According to one embodiment, in a cellulosic product of three or more layers the outer layers have a grammage from about 10 to about 750, such as from about 20 to about 400 or from about 30 to about 200 g/m$^2$. The density of the outer layers is preferably from about 300 to about 1200 kg/m$^3$, most preferably from about 400 to about 1000 kg/m$^3$ or from about 450 to about 900 kg/m$^3$. The centre, or non-outer, layer or layers preferably have a grammage from about 10 to about 750 g/m$^2$, most preferably from about 25 to about 400 g/m$^2$ or from about 50 to about 200 g/m$^2$. The density of the centre, or non-outer layer or layers are preferably from about 10 to about 800 kg/m$^3$, most preferably from about 50 to about 700 kg/m$^3$ or from about 100 to about 600 kg/m$^3$. The total grammage is preferably from about 30 to about 2250 g/m$^2$, most preferably from about 65 to about 800 g/m$^2$ or from about 110 to about 600 g/m$^2$. The total density is preferably from about 100 to about 1000 kg/m$^3$, most preferably from about 200 to about 900 kg/m$^3$ or from about 400 to about 800 kg/m$^3$.

According to one embodiment, the cellulosic product has separate layers for providing liquid and gas barriers, respectively, but in an embodiment a liquid barrier layer and a gas barrier layer is provided by a single layer of a material having both liquid and gas barrier properties.

According to one embodiment, a multilayered cellulosic product can be produced by forming the individual layers separately in one or several web-forming units and then couching them together in the wet state. Examples of suitable grades of multilayered cellulosic product of the invention include those comprising from three to seven layers comprising cellulosic fibers and at least one of said cellulosic layers comprising thermoplastic microspheres and microfibrillar polysaccharide. In multilayered cellulosic products with three or more layers, such as at least one of the middle layers comprises thermoplastic microspheres and microfibrillar polysaccharide.

According to one embodiment, at least one layer of the cellulosic product can be formed and pressed in a separate stage before being laminated to a further layer. Following the pressing stage, the laminate can be dried in conventional drying equipment such as cylinder dryer with or without dryer wire/felt, air dryer, metal belt etc. Following drying or during the drying process, the laminate can be coated with a further layer.

According to one embodiment, the aqueous suspension contains cellulosic fibers from chemical pulp, such as sulfate (kraft) and sulfite pulp, organosolv pulp; recycled fibers; and/or mechanical pulp including e.g. refiner mechanical pulp (RMP), pressurized refiner mechanical pulp (PRMP), pretreatment refiner chemical alkaline peroxide mechanical pulp (P-RC APMP), thermomechanical pulp (TMP), thermomechanical chemical pulp (TMCP), high-temperature TMP (HT-TMP) RTS-TMP, alkaline peroxide pulp (APP), alkaline peroxide mechanical pulp (APMP), alkaline peroxide thermomechanical pulp (APTMP), thermopulp, groundwood pulp (GW), stone groundwood pulp (SGW), pressure groundwood pulp (PGW), super pressure groundwood pulp (PGW-S), thermo groundwood pulp (TGW), thermo stone groundwood pulp (TSGW), chemimechanical pulp (CMP), chemirefinermechanical pulp (CRMP), chemithermomechanical pulp (CTMP), high-temperature CTMP (HT-CTMP), sulfite-modified thermomechanical pulp (SMTMP), reject CTMP (CTMP$_R$), groundwood CTMP (G-CTMP), semichemical pulp (SC), neutral sulfite semi chemical pulp (NSSC), high-yield sulfite pulp (HYS), biomechanical pulp (BRMP), pulps produced according to the OPCO process, explosion pulping process, Bi-V is process, dilution water sulfonation process (DWS), sulfonated long fibers process (SLF), chemically treated long fibers process (CTLF), long fiber CMP process (LFCMP), and modifications and combinations thereof. The pulp may be a bleached or non-bleached pulp. According to one embodiment, the aqueous suspension contains mechanical, recycled and/or kraft pulp.

Cellulosic fibers can be derived from hardwood, softwood species, and/or nonwood. Examples of hardwood and softwood include birch, beech, aspen such as European aspen, alder, Eucalyptus, maple, acacia, mixed tropical hardwood, pine such as loblolly pine, fir, hemlock, larch, spruce such as Black spruce or Norway spruce, and mixtures thereof. Nonwood plant raw material can be provided from e.g. straws of grain crops, wheat straw reed canary grass, reeds, flax, hemp, kenaf, jute, ramie, seed, sisal, abaca, coir, bamboo, bagasse or combinations thereof.

According to one embodiment, the cellulosic fibers of the aqueous suspension are derived from hardwood and/or softwood species.

According to one embodiment, at least one outer layer of the cellulosic product is produced from a chemical pulp obtained in accordance with any of the methods as disclosed herein or other conventional methods for obtaining chemical pulp. The pulps may be bleached or unbleached.

According to one embodiment, a laminate, for example a board such as a liquid packaging board, comprising at least three layers is formed whereby the product is obtained by joining directly or indirectly an inner layer formed from an aqueous suspension comprising microfibrillar polysaccharide and optionally thermoplastic microspheres and further layers joined to said inner layer's respective sides, said further layers being produced from an aqueous suspension with or without microfibrillar polysaccharide and optionally thermoplastic microspheres.

Further layers, e.g. barrier layers, may be formed and joined on the outer layers as defined. Any of the layers can also be coated to improve e.g. printability of the laminate. According to one embodiment, any coated or non-coated layer may in turn be coated with a plastic or polymer layer. Such coating may further reduce liquid penetration and improve heat-sealing properties of the product.

According to one embodiment, at least one layer of a laminate is produced from a mechanical and/or chemical pulp obtained from wood or nonwood pulp in accordance with any of the methods as disclosed herein or other conventional methods for obtaining pulp. According to one embodiment, the layer is produced from at least about 40, e.g. at least about 50, for example at least about 60 or at least about 75 wt % mechanical pulp based on the total pulp weight. The pulps may be bleached or unbleached.

According to one embodiment, the aqueous suspension has a consistency of cellulosic fibers in an amount from about 0.01 to about 50, for example from about 0.1 to about 25 or from about 0.1 to about 10 wt %.

According to one embodiment, the aqueous suspension contains mineral fillers of conventional types, such as, for example, kaolin, clay, titanium dioxide, gypsum, talc and both natural and synthetic calcium carbonates, such as, for example, chalk, ground marble, ground calcium carbonate, and precipitated calcium carbonate. The aqueous suspension can also contain papermaking additives of conventional types, such as drainage and retention chemicals, dry strength agents, sizing agents, such as those based on rosin, ketene dimers, ketene multimers, alkenyl succinic anhydrides, etc.

The cellulosic product may further comprise a wet strength agent that is added to the stock before dewatering. Suitable wet strength agents include resins of polyamine epihalohydrin, polyamide epihalohydrin, polyaminoamide epihalohydrin, urea/formaldehyde, urea/melamine/formaldehyde, phenol/formaldehyde, polyacrylic amide/glyoxal condensate, polyvinyl amine, poly-urethane, polyisocyanate, and mixtures thereof, of which polyaminoamide epichlorohydrin (PAAE) is particularly preferred.

According to one embodiment, wet and dry strength agents may be added in amounts from about 0.1 to about 30 kg/t cellulosic product, such as from about 0.5 to about 10 kg/t pulp. According to one embodiment, sizing agent(s) may be added in amounts from about 0.1 to about 10, such as from about 0.5 to about 4 kg/t cellulosic product. Further paper chemicals may be added to the aqueous suspension in conventional manner and amounts.

According to one embodiment, the invention is applied on paper machines producing wood-containing paper or board and/or paper or board based on recycled fibers, different types of book and newsprint papers, and/or on machines producing nonwood-containing printing and writing papers.

According to one embodiment, the invention further concerns a composition comprising microfibrillar polysaccharide and thermoplastic microspheres as disclosed herein. According to one embodiment, the composition is aqueous. According to one embodiment, the weight ratio of microfibrillar polysaccharide to thermoplastic microspheres in the composition ranges from about 1:100 to about 200:1, for example from about 1:20 to about 40:1 or from about 1:5 to about 20:1 or from about 1:2 to about 10:1 or from about 1:1 to about 8:1 or from about 2:1 to about 5:1.

According to one embodiment, the invention further concerns the use of the composition in the production of a cellulosic product.

The invention also regards a cellulosic product obtainable by the process as defined herein. The invention also regards a cellulosic product comprising microfibrillar polysaccharide and thermoplastic microspheres. The invention also regards a single layer cellulosic product comprising microfibrillar polysaccharide. The invention also regards a single layer cellulosic product comprising microfibrillar polysaccharide and optionally thermoplastic microspheres.

According to one embodiment, the weight ratio of microfibrillar polysaccharide to thermoplastic microspheres in the cellulosic product ranges from about 1:100 to about 200:1, for example from about 1:20 to about 40:1 or from about 1:5 to about 20:1 or from about 1:2 to about 10:1 or from about 1:1 to about 8:1 or from about 2:1 to about 5:1. According to one embodiment, the composition comprises an electrolyte such as a cationic electrolyte.

According to one embodiment, the cellulosic product may be any of those obtained herein including any of their properties. For example, the grammage can be within the ranges as defined herein. According to one embodiment, the cellulosic product may comprise any pulp as disclosed herein, especially mechanical pulp, recycled pulp and/or kraft pulp.

The invention also concerns the use of the cellulosic product, e.g. as liquid packaging board, folding box board, or liner. According to one embodiment, the product is used in the form of a packaging laminate, which may be used for the production of sealed packages for liquid, food or non-food products. According to one embodiment, the invention concerns the use of a cellulosic product for the production of a sealed package comprising the steps of forming a container from a packaging laminate, filling the container with a food or beverage product, and sealing the container, wherein said packaging laminate comprises at least one base layer of paper or paperboard and at least one liquid barrier layer, and preferably at least one gas barrier layer, said paper or paperboard comprising, preferably at least at the edges thereof, expanded or unexpanded expandable thermoplastic microspheres.

In one embodiment the cellulosic product is used for packaging of food that do not need to be heat treated after the package has been filled and sealed. Usually such packages are used for beverages like milk, juice and other soft drinks, soups, and tomato products.

In another embodiment the cellulosic product package is used for food or beverages where the filled and sealed package is heat treated to increase the shelf life of the content. Such packages can be used for all kinds of food products, particularly those traditionally being packed in tin cans, and will herein be referred to as retortable packages and the material therefore as retortable packaging laminate or retortable board. Desired properties of a retortable packaging laminate include ability to withstand treatment with saturated steam at a high temperature and pressure, for example from about 110 to about 150° C. at a time from about 30 minutes to about 3 hours.

The invention being thus described, it will be obvious that the same may be varied in many ways. The following examples will further illustrate how the described invention may be performed without limiting the scope of it.

All parts and percentages refer to part and percent by weight, if not otherwise stated.

EXAMPLE 1

A) A single layer cellulosic product (A1) with a grammage of approximately 170 g/m$^2$ was produced from Timsfors test liner (Shopper Riegler 47) using a dynamic sheet former (Formette Dynamic, supplied by Fibertech AB, Sweden). Paper sheets were formed in the Dynamic Sheet Former by pumping the stock (pulp consistency: 0.5%, conductivity 2000 μm/s, pH 7) from the mixing chest through a transversing nozzle into the rotating drum onto the water film on top of the wire, draining the stock to form a sheet, pressing and drying the sheet. The amounts of chemicals added to the suspension (based on the weight of cellulosic product) and addition time (in seconds) prior to pumping and sheet formation were the following:

TABLE 1

| Time (s) | Amount (%) | Product | Chemical |
|---|---|---|---|
| 120 | 0 | PC155 or BMC | Anionic potato starch or MFC (microfibrillar cellulose) |
| 60 | 0.2 | Eka DR 28HF | AKD (alkyl ketene dimer) |
| 45 | 0.6 | Perlbond 970 | Cationic potato starch |
| 30 | 0.03 | Eka PL1510 | Cationic polyacrylamide |
| 15 | 0.05 | NP442 | Colloidal silica sol |
| 0 | | Pumping | |

The dewatering time was 90 s. The paper sheets were pressed at 3 bars in a roll press and thereafter dried restrained in a plane drier at 105° C. for 16 minutes.

B) Single layer cellulosic products with a grammage of approximately 170 g/m$^2$ were prepared as in A), but with addition of 2 and 5% (based on the weight of cellulosic product) PC155 (anionic potato starch) respectively (B1-B2).

C) Single layer paper products with a grammage of approximately 170 g/m$^2$ were prepared as in A), but with addition of 2, 5 and 10% (based on the weight of cellulosic product) microfibrillar cellulose (prepared from unbleached kraft pulp from SöCell AB, Sweden) (C1-C3). The characteristics of the microfibrillar cellulose were as follows: Fiber length: 0.29 mm (Kajaani FS-100 Fiber Size Analyser), specific surface area 5 g/m$^2$ (BET method using a Micrometrics ASAP 2010 instrument), viscosity: 808 mpas, stability:100% (sedimentation degree of a 0.5% pulp suspension: Water Retention Value (WRV): 4.0 (g/g) (SCAN-C 62:00).

Single layer cellulosic products prepared according to A), B) and C) were analyzed for their grammage, density, tensile strength, burst strength, Z-strength, geometrical bending resistance and porosity (see Table 2).

TABLE 2

| | | A | B | | C | | |
|---|---|---|---|---|---|---|---|
| Paper Property | Unit | 1 | 1 | 2 | 1 | 2 | 3 |
| Density | kg/m$^3$ | 572 | 569 | 580 | 576 | 590 | 613 |
| Tensile Index | Nm/g | 50.8 | 51.8 | 54.8 | 55.3 | 60.4 | 65.6 |
| Tensile Stiffness Index | kNm/g | 6.0 | 6.0 | 6.1 | 6.3 | 6.6 | 7.0 |
| Bending Resistance Index | Nm$^6$/kg$^3$ | 12.3 | 12.2 | 12.4 | 12.8 | 13.0 | 13.1 |
| Geom. Bending Resistance | mN | 58 | 58 | 61 | 59 | 60 | 61 |
| Z-Strength | kPa | 565 | 547 | 564 | 591 | 599 | 649 |
| Burst Index | kPa m$^2$/g | 3.3 | 3.2 | 3.5 | 3.6 | 3.8 | 4.3 |
| Bendtsen Porosity | ml/min | 308 | 325 | 305 | 272 | 182 | 80 |

EXAMPLE 2

A) A single layer cellulosic product (A1) with a grammage of approximately 170 g/m$^2$ was produced from a CTMP-pulp (CSF 400) from Södra Cell AB using a dynamic sheet former (Formette Dynamic, supplied by Fibertech AB, Sweden). Paper sheets were formed as in Example 1, but with a pulp conductivity of 1500 μm/s. The amounts of chemicals added to the suspension (based on the weight of cellulosic product) and addition time (in seconds) prior to pumping and sheet formation were as in Example 1. The sheets were drained, pressed and dried as in Example 1.

B) Single layer cellulosic products with a grammage of approximately 170 g/m$^2$ were prepared as in A), but with addition of 2 and 5% (based on the weight of cellulosic product) PC155 (anionic potato starch), respectively (B1-B2).

C) Single layer cellulosic products with a grammage of approximately 170 g/m$^2$ were prepared as in A), but with addition of 2, 5 and 10% (based on the weight of cellulosic product) microfibrillar cellulose (prepared from fully bleached birch kraft pulp fibers from Iggesund) (C1-C3). The characteristics of the microfibrillar cellulose were the following: Fiber length: 0.37 mm (L&W Fiber Tester), stability: 94% (sedimentation degree of a 0.5% pulp suspension: Water Retention Value (WRV): 6.8 (g/g) (SCAN-C 62:00).

Single layer cellulosic products prepared according to A), B) and C) were analyzed for their grammage, density, tensile strength, burst strength, Z-strength, geometrical bending resistance and porosity (see Table 3).

TABLE 3

| Paper | | A | B | | C | | |
|---|---|---|---|---|---|---|---|
| Property | Unit | 1 | 1 | 2 | 1 | 2 | 3 |
| Density | kg/m$^3$ | 331 | 320 | 335 | 342 | 363 | 401 |
| Tensile Index | Nm/g | 30.7 | 31.0 | 32.7 | 35.5 | 41.2 | 49.4 |
| Tensile Stiffness Index | kNm/g | 3.7 | 3.6 | 3.8 | 4.0 | 4.5 | 4.8 |
| Bending Resistance Index | Nm$^6$/kg$^3$ | 26.1 | 27.5 | 23.0 | 27.2 | 24.9 | 24.4 |
| Geom. Bending Resistance | mN | 165 | 171 | 134 | 170 | 151 | 146 |
| Z-Strength | kPa | 214 | 220 | 246 | 275 | 296 | 416 |
| Burst Index | kPa m$^2$/g | 1.9 | 1.6 | 2.0 | 1.8 | 2.4 | 2.6 |
| Bendtsen Porosity | ml/min | 1775 | 1500 | 1150 | 912 | 675 | 228 |

EXAMPLE 3

A) A single layer cellulosic product (A1) with a grammage of approximately 170 g/m$^2$ were produced from Timsfors test liner using a dynamic sheet former (Formette Dynamic, supplied by Fibertech AB, Sweden) as in Example 1, but without chemicals. Paper sheets were formed, drained, pressed and dried as in Example 1.

B) Single layer cellulosic products with a grammage of 170 g/m$^2$ were prepared as in A), but with addition of 2, 5 and 10% (based on the weight of cellulosic product) microfibrillar cellulose (prepared from unbleached kraft pulp from Södra Cell AB, Sweden) (B1-B3). The characteristics of the microfibrillar cellulose were the following: Fiber length: 0.29 mm (Kajaani FS-100 Fiber Size Analyser), specific surface area 5 g/m$^2$ (BET method using a Micrometrics ASAP 2010 instrument), viscosity: 808 mPas, stability:100% (sedimentation degree of a 0.5% pulp suspension: Water Retention Value (WRV): 4.0 (g/g) (SCAN-C 62:00).

Paper products prepared according to A) and B) were analyzed for their grammage, density, tensile strength, burst strength, Z-strength, geometrical bending resistance and porosity (see Table 4).

TABLE 4

| | | | B | | |
|---|---|---|---|---|---|
| Paper Property | Unit | A1 | 1 | 2 | 3 |
| Density | kg/m$^3$ | 569 | 574 | 590 | 609 |
| Tensile Index | Nm/g | 46.3 | 56.2 | 56.2 | 60.7 |
| Tensile Stiffness Index | kNm/g | 5.8 | 6.3 | 6.4 | 6.9 |
| Bending Resistance Index | Nm$^6$/kg$^3$ | 12.0 | 11.8 | 12.1 | 13.0 |
| Geom. Bending Resistance | mN | 48 | 56 | 54 | 47 |
| Z-Strength | kPa | 443 | 581 | 566 | 612 |
| Burst Index | kPa m$^2$/g | 2.9 | 3.4 | 3.6 | 4.1 |
| Bendtsen Porosity | ml/min | 232 | 275 | 122 | 62 |

EXAMPLE 4

A) A single layer cellulosic product (A1) with a grammage of approximately 170 g/m$^2$ was produced from a CTMP-pulp (CSF 400) from Södra Cell AB using a dynamic sheet former (Formette Dynamic, supplied by Fibertech AB, Sweden) as in Example 1, but without chemicals. Paper sheets were formed, drained, pressed and dried as in Example 1.

B) Single layer cellulosic products with a grammage of approximately 170 g/m$^2$ were prepared as in A), but with addition of 2, 5 and 10% (based on the weight of cellulosic product) microfibrillar cellulose (prepared from fully bleached birch kraft pulp fibers from Iggesund) (B1-B3). The characteristics of the microfibrillar cellulose were the following: Fiber length: 0.37 mm (L&W Fiber Tester), stability: 94% (sedimentation degree of a 0.5% pulp suspension: Water Retention Value (WRV): 6.8 (g/g) (SCAN-C 62:00).

Single layer cellulosic products prepared according to A) and B) were analyzed for their grammage, density, tensile strength, burst strength, Z-strength, geometrical bending resistance and porosity (see Table 5).

TABLE 5

| | | | B | | |
|---|---|---|---|---|---|
| Paper Property | Unit | A1 | 1 | 2 | 3 |
| Density | kg/m$^3$ | 310 | 348 | 378 | 391 |
| Tensile Index | Nm/g | 30.3 | 32.0 | 36.1 | 43.1 |
| Tensile Stiffness Index | kNm/g | 3.3 | 3.9 | 4.3 | 4.6 |
| Bending Resistance Index | Nm$^6$/kg$^3$ | 22.3 | 21.8 | 21.8 | 22.2 |
| Geom. Bending Resistance | mN | 99 | 131 | 134 | 118 |
| Z-Strength | kPa | 93 | 218 | 267 | 336 |
| Burst Index | kPa m$^2$/g | 0.8 | 1.7 | 2.1 | 2.4 |
| Bendtsen Porosity | ml/min | 505 | 729 | 270 | 205 |

EXAMPLE 5

A) A single layer cellulosic product (A1) with a grammage of approximately 170 g/m$^2$ was produced from Timsfors test liner (Shopper Riegler 47) using a dynamic sheet former (Formette Dynamic, supplied by Fibertech AB, Sweden). Paper sheets were formed in the Dynamic Sheet Former by pumping the stock (pulp consistency: 0.5%, conductivity 2000 μm/s, pH 7) from the mixing chest through a transversing nozzle into the rotating drum onto the water film on top of the wire, draining the stock to form a sheet, pressing and drying the sheet. The amounts of chemicals added to the suspension (based on the weight of cellulosic product) and addition time (in seconds) prior to pumping and sheet formation were the following

TABLE 6

| Time (s) | Amount (%) | Product | Chemical |
|---|---|---|---|
| 145 | 0 | BMC | MFC (microfibrillar cellulose) |
| 120 | 0.13 | Eka WS XO | PAAE (polyamidoamine epichlorohydrine) |
| 75 | 0.2 | Eka DR 28HF | AKD (alkyl ketene dimer) |
| 60 | 0.6 | Perlbond 970 | Cationic potato starch |
| 45 | 0 | 820 SL 80 | Thermoplastic microsphere or Premix of MFC and 820 SL 80 |
| 30 | 0.03 | Eka PL1510 | Cationic polyacrylamide |
| 15 | 0.05 | NP442 | Colloidal silica sol |
| 0 | | Pumping | |

The dewatering time was 90 s. The paper sheets were pressed at 4.85 bars in a plane press for 7 minutes and thereafter dried in a photo drier (Japo automatic glazing drier) at 120° C.

B) Single layer cellulosic products with a grammage of approximately 170 g/m$^2$ were prepared as in A), but with addition of 1 and 2% (based on the weight of cellulosic product) 820 SL 80 (B1-B2).

C) Single layer cellulosic products with a grammage of approximately 170 g/m$^2$ were prepared as in A), but 1% of 820 SL 80 was premixed with 5, 10 and 15% (based on the weight of cellulosic product) microfibrillar cellulose (prepared from unbleached kraft pulp from Södra Cell AB, Sweden) (C1-C3). The characteristics of the microfibrillar cellulose were the following: Fiber length: 0.29 mm (Kajaani FS-100 Fiber Size Analyser), specific surface area 5 g/m$^2$ (BET method using a Micrometrics ASAP 2010 instrument), viscosity: 808 mPas, stability: 100% (sedimentation degree of a 0.5% pulp suspension: Water Retention Value (WRV): 4.0 (g/g) (SCAN-C 62:00).

D) Single layer cellulosic products with a grammage of approximately 170 g/m$^2$ were prepared as in A), but 2% of 820 SL 80 was premixed with 5, 10 and 15% (based on the weight of cellulosic product) microfibrillar cellulose (prepared from unbleached kraft pulp from Södra Cell AB, Sweden) (D1-D3). The characteristics of the microfibrillar cellulose were as in C).

E) Single layer cellulosic products with a grammage of approximately 170 g/m$^2$ were prepared as in B), but with addition of 10% (based on the weight of cellulosic product) microfibrillar cellulose (prepared from unbleached kraft pulp from Södra Cell AB, Sweden) (E1-E2). The characteristics of the microfibrillar cellulose were as in C).

Single layer cellulosic products prepared according to A), B), C), D) and E) were analyzed for their grammage, density, tensile strength, burst strength, Z-strength, geometrical bending resistance, edge wick and porosity (see Table 7a and 7b).

TABLE 7a

| | | A | B | | C | | |
|---|---|---|---|---|---|---|---|
| Paper Property | Unit | 1 | 1 | 2 | 1 | 2 | 3 |
| Density | kg/m$^3$ | 669 | 539 | 441 | 581 | 612 | 637 |
| Tensile Index | Nm/g | 48.0 | 40.3 | 36.7 | 46.1 | 50.5 | 52.1 |
| Tensile Stiffness Index | kNm/g | 4.9 | 3.9 | 3.4 | 4.2 | 4.7 | 4.7 |
| Bending Resistance Index | Nm$^6$/kg$^3$ | 8.3 | 13.3 | 17.9 | 11.6 | 9.9 | 8.9 |
| Geom. Bending Resistance | mN | 47 | 73 | 95 | 66 | 59 | 53 |
| Z-Strength | kPa | 642 | 561 | 395 | 656 | 719 | 721 |
| Burst Index | kPa m$^2$/g | 4.0 | 3.2 | 2.8 | 3.8 | 4.2 | 4.9 |
| Edge wick | kg/m$^2$ | 1.7 | 1.6 | 1.7 | 1.4 | 1.2 | 1.2 |
| Bendtsen Porosity | ml/min | 129 | 392 | 650 | 178 | 88 | 50 |

TABLE 7b

| | | D | | | E | |
|---|---|---|---|---|---|---|
| Paper Property | Unit | 1 | 2 | 3 | 1 | 2 |
| Density | kg/m$^3$ | 492 | 502 | 499 | 638 | 511 |
| Tensile Index | Nm/g | 41.1 | 46.2 | 47.5 | 51.1 | 47.0 |
| Tensile Stiffness Index | kNm/g | 3.6 | 4.0 | 4.2 | 4.7 | 3.9 |
| Bending Resistance Index | Nm$^6$/kg$^3$ | 14.9 | 13.4 | 12.1 | 9.1 | 13.6 |
| Geom. Bending Resistance | mN | 87 | 79 | 67 | 59 | 83 |
| Z-Strength | kPa | 526 | 618 | 670 | 712 | 587 |
| Burst Index | kPa m$^2$/g | 3.5 | 3.9 | 4.4 | 4.4 | 4.0 |
| Edge wick | kg/m$^2$ | 1.5 | 1.5 | 1.1 | 1.3 | 1.5 |
| Bendtsen Porosity | ml/min | 302 | 162 | 70 | 60 | 132 |

EXAMPLE 6

A) A single layer cellulosic product (A1) with a grammage of approximately 170 g/m$^2$ was produced from a hardwood CTMP-pulp (CSF 465) from M-real using a dynamic sheet former (Formette Dynamic, supplied by Fibertech AB, Sweden). Paper sheets were formed in the Dynamic Sheet Former by pumping the stock (pulp consistency: 0.5%, conductivity 1500 μm/s, pH 7) from the mixing chest through a transversing nozzle into the rotating drum onto the water film on top of the wire, draining the stock to form a sheet, pressing and drying the sheet. The amounts of chemicals added to the suspension (based on the weight of cellulosic product) and addition time (in seconds) prior to pumping and sheet formation were as follows:

TABLE 8

| Time (s) | Amount (%) | Product | Chemical |
|---|---|---|---|
| 145 | 0 | BMC | MFC (microfibrillar cellulose) |
| 120 | 0.13 | Eka WS XO | PAAE (polyamidoamine epichlorohydrine) |
| 75 | 0.2 | Eka DR 28HF | AKD (alkyl ketene dimer) |
| 60 | 0.6 | Perlbond 970 | Cationic potato starch |
| 45 | 0 | 820 SL 80 | Thermoplastic microspheres or Premix of MFC and 820 SL 80 |
| 30 | 0.03 | Eka PL1510 | Cationic polyacrylamide |
| 15 | 0.05 | NP442 | Colloidal silica sol |
| 0 | | Pumping | |

The dewatering time was 90 s. The paper sheets were pressed at 4.85 bars in a plane press for 7 minutes and thereafter dried in a photo drier (Japo automatic glazing drier) at 120° C.

B) Single layer cellulosic products with a grammage of approximately 170 g/m$^2$ were prepared as in A), but with addition of 1 and 2% (based on the weight of cellulosic product) 820 SL 80, (B1-B2).

C) Single layer cellulosic products with a grammage of approximately 170 g/m$^2$ were prepared as in A), but 1% of 820 SL 80 was premixed with 5, 10 and 15% (based on the weight of cellulosic product) microfibrillar cellulose (prepared from a ECF-bleached Eucalyptus Globulus kraft pulp from Portugal) (C1-C3). The characteristics of the microfibrillar cellulose were the following: Fiber length: 0.41 mm ((L&W Fiber Tester) and stability:94% (sedimentation degree of a 0.5% pulp suspension; water retention value (WRV): 6.8 g/g.

D) Single layer cellulosic products with a grammage of approximately 170 g/m$^2$ were prepared as in A), but 2% of 820 SL 80 was premixed with 5, 10 and 15% (based on the weight of cellulosic product) microfibrillar cellulose (prepared from unbleached kraft pulp from Södra Cell AB, Sweden) (D1-D3). The characteristics of the microfibrillar cellulose were as in C).

E) Single layer cellulosic products with a grammage of approximately 170 g/m$^2$ were prepared as in B), but with addition of 10% (based on the weight of cellulosic product) microfibrillar cellulose (prepared from unbleached kraft pulp from Södra Cell AB, Sweden) (E1-E2). The characteristics of the microfibrillar cellulose were as in C):

Single layer cellulosic products prepared according to A), B), C), D) and E) were analyzed for their grammage, density, tensile strength, burst strength, Z-strength, geometrical bending resistance, edge wick and porosity (see Table 9a and 9b).

TABLE 9a

| | | A | B | | C | | |
|---|---|---|---|---|---|---|---|
| Paper Property | Unit | 1 | 1 | 2 | 1 | 2 | 3 |
| Density | kg/m$^3$ | 399 | 326 | 283 | 363 | 401 | 403 |
| Tensile Index | Nm/g | 20.0 | 17.2 | 13.8 | 22.2 | 28.0 | 35.0 |
| Tensile Stiffness Index | kNm/g | 3.0 | 2.5 | 1.8 | 2.9 | 3.3 | 3.9 |
| Bending Resistance Index | Nm$^6$/kg$^3$ | 16.0 | 20.7 | 22.1 | 19.2 | 15.6 | 15.5 |
| Geom. Bending Resistance | mN | 68 | 92 | 96 | 88 | 82 | 73 |
| Z-Strength | kPa | 262 | 175 | 149 | 293 | 363 | 509 |
| Burst Index | kPa m$^2$/g | 0.69 | 0.52 | 0.48 | 0.89 | 1.50 | 1.96 |
| Edge wick | kg/m$^2$ | 7.6 | 7.3 | 7.3 | 6.3 | 5.4 | 4.3 |
| Bendtsen Porosity | ml/min | 2138 | 2412 | 2750 | 1700 | 975 | 462 |

TABLE 9b

| | | D | | | E | |
|---|---|---|---|---|---|---|
| Paper Property | Unit | 1 | 2 | 3 | 1 | 2 |
| Density | kg/m$^3$ | 320 | 345 | 365 | 393 | 359 |
| Tensile Index | Nm/g | 18.9 | 23.6 | 31.2 | 29.1 | 25.8 |
| Tensile Stiffness Index | kNm/g | 2.4 | 2.8 | 3.4 | 3.4 | 3.0 |
| Bending Resistance Index | Nm$^6$/kg$^3$ | 21.5 | 21.3 | 18.4 | 18.8 | 21.6 |
| Geom. Bending Resistance | mN | 96 | 96 | 93 | 90 | 103 |
| Z-Strength | kPa | 279 | 299 | 423 | 279 | 313 |
| Burst Index | kPa m$^2$/g | 0.78 | 1.15 | 1.47 | 1.46 | 1.29 |
| Edge wick | kg/m$^2$ | 6.4 | 5.8 | 4.8 | 4.9 | 4.8 |
| Bendtsen Porosity | ml/min | 2225 | 1575 | 550 | 975 | 1050 |

EXAMPLE 7

A) Single layer cellulosic products (A1-A5) with a grammage of approximately 100, 150, 190, 230 and 280 g/m$^2$ were produced from a softwood CTMP pulp from Östrand (CSF 500) using a dynamic sheet former (Formette Dynamic, supplied by Fibertech AB, Sweden). Paper sheets were formed in the Dynamic Sheet Former by pumping the stock (pulp consistency: 0.5%, conductivity 1500 μm/s, pH 7) from the mixing chest through a transversing nozzle into the rotating drum onto the water film on top of the wire, draining the stock to form a sheet, pressing and drying the sheet. The amounts of chemicals added to the suspension (based on the weight of cellulosic product) and addition time (in seconds) prior to pumping and sheet formation were the following:

TABLE 10

| Time (s) | Amount (%) | Product | Chemical |
|---|---|---|---|
| 145 | 0 | BMC | MFC (microfibrillar cellulose) |
| 120 | 0.13 | Eka WS XO | PAAE (polyamidoamine epichlorohydrine) |
| 75 | 0.2 | Eka DR 28HF | AKD (alkyl ketene dimer) |
| 60 | 0.6 | Perlbond 970 | Cationic potato starch |
| 45 | 0 | 820 SL 80 | Thermoplastic microspheres |
| 30 | 0.03 | Eka PL1510 | Cationic polyacrylamide |
| 15 | 0.05 | NP442 | Colloidal silica sol |
| 0 | | Pumping | |

The dewatering time was 90 s. The paper sheets were pressed at 4.85 bars in a plane press for 7 minutes and thereafter dried in a photo drier (Japo automatic glazing drier) at 120° C.

B) Single layer cellulosic products with a grammage of approximately 100, 150 and 190 g/m$^2$ were prepared as in A), but with addition of 2% (based on the weight of cellulosic product) 820 SL 80, (B1-B3).

C) Single layer cellulosic products with a grammage of approximately 100, 150 and 190 g/m$^2$ were prepared as in B), but with 5% (based on the weight of cellulosic product) microfibrillar cellulose (prepared from a ECF-bleached Eucalyptus Globulus kraft pulp from Portugal) (C1-C3). The characteristics of the microfibrillar cellulose were the following: Fiber length: 0.41 mm (L&W Fiber Tester) and stability:94% (sedimentation degree of a 0.5% pulp suspension; water retention value (WRV): 6.8 g/g.

D) Single layer cellulosic products with a grammage of approximately 100, 150 and 190 g/m$^2$ were prepared as in B), but with 10% (based on the weight of cellulosic product) microfibrillar cellulose (prepared from a ECF-bleached Eucalyptus Globulus kraft pulp from Portugal) (D1-D3). The characteristics of the microfibrillar cellulose were as in C).

E) Single layer cellulosic products with a grammage of approximately 100, 150 and 190 g/m$^2$ were prepared as in A), but with 5% (based on the weight of cellulosic product) microfibrillar cellulose (prepared from a ECF-bleached Eucalyptus Globulus kraft pulp from Portugal) (E1-E3). The characteristics of the microfibrillar cellulose were as in C).

F) Single layer cellulosic products with a grammage of approximately 100, 150 and 190 g/m$^2$ were prepared as in A), but with 10% (based on the weight of cellulosic product) microfibrillar cellulose (prepared from a ECF-bleached Eucalyptus Globulus kraft pulp from Portugal) (F1-F3). The characteristics of the microfibrillar cellulose were as in C).

G) A single layer cellulosic product with a grammage of approximately 150 g/m$^2$ was prepared as in A), but with 3% (based on the weight of cellulosic product) of 820 SL 80 (G1)

H) A single layer cellulosic product with a grammage of approximately 150 g/m$^2$ was prepared as in G), but with addition of 10% (based on the weight of cellulosic product) microfibrillar cellulose (prepared from a ECF-bleached Eucalyptus Globulus kraft pulp from Portugal) (H1). The characteristics of the microfibrillar cellulose were as in C).

I) A single layer cellulosic product with a grammage of approximately 150 g/m$^2$ was prepared as in G), but with addition of 15% (based on the weight of celulosic product) microfibrillar cellulose (prepared from a ECF-bleached Eucalyptus Globulus kraft pulp from Portugal) (I1). The characteristics of the microfibrillar cellulose were as in C).

J) A single layer cellulosic product with a grammage of approximately 150 g/m$^2$ was prepared as in A), but with addition of 15% (based on the weight of cellulosic product) microfibrillar cellulose (prepared from a ECF-bleached Eucalyptus Globulus kraft pulp from Portugal) (J1). The characteristics of the microfibrillar cellulose were as in C).

Single layer cellulosic products prepared according to A), B), C), D), E), F), G), H), I), and J) were analyzed for their grammage, density, tensile strength, burst strength, Z-strength, geometrical bending resistance and porosity (see Table 11a-11d).

TABLE 11a

| | | A | | | | | B | | |
|---|---|---|---|---|---|---|---|---|---|
| Paper Property | Unit | 1 | 2 | 3 | 4 | 5 | 1 | 2 | 3 |
| Grammage | g/m$^2$ | 102 | 145 | 185 | 231 | 278 | 102 | 146 | 189 |
| Density | kg/m$^3$ | 463 | 484 | 467 | 484 | 481 | 339 | 320 | 345 |
| Tensile strength | kN/m | 3.90 | 5.42 | 6.51 | 7.66 | 9.61 | 2.9 | 3.92 | 5.28 |
| Tensile Stiffness | kN/m | 445 | 589 | 670 | 740 | 888 | 335 | 406 | 515 |
| Geom. Bending Resistance | mN | 15 | 41 | 84 | 138 | 255 | 27 | 73 | 134 |
| Bending Resistance Index | Nm$^6$/kg$^3$ | 13.3 | 13.0 | 12.4 | 10.6 | 11.2 | 24.9 | 22.4 | 18.9 |
| Z-Strength | kPa | 376 | 505 | 454 | 469 | 410 | 307 | 278 | 286 |
| Burst strength | kPa | 230 | 361 | 463 | 598 | 662 | 177 | 236 | 318 |
| Bendtsen Porosity | ml/min | 1462 | 235 | 168 | 95 | 76 | 1575 | 800 | 400 |

TABLE 11b

| | | C | | | D | | |
|---|---|---|---|---|---|---|---|
| Paper Property | Unit | 1 | 2 | 3 | 1 | 2 | 3 |
| Grammage | $g/m^2$ | 104 | 146 | 192 | 105 | 149 | 197 |
| Density | $kg/m^3$ | 374 | 358 | 368 | 376 | 379 | 402 |
| Tensile strength | kN/m | 3.64 | 4.70 | 6.14 | 3.98 | 5.61 | 7.79 |
| Tensile Stiffness | kN/m | 391 | 468 | 572 | 423 | 531 | 680 |
| Geom. Bending Resistance | mN | 24 | 70 | 138 | 23 | 62 | 149 |
| Bending Resistance Index | $Nm^6/kg^3$ | 20.3 | 21.4 | 18.5 | 19.4 | 17.9 | 18.0 |
| Z-Strength | kPa | 406 | 368 | 377 | 521 | 494 | 486 |
| Burst Strength | kPa | 243 | 342 | 424 | 288 | 399 | 570 |
| Bendtsen Porosity | ml/min | 762 | 302 | 260 | 410 | 232 | 145 |

TABLE 11c

| | | E | | | F | | |
|---|---|---|---|---|---|---|---|
| Paper Property | Unit | 1 | 2 | 3 | 1 | 2 | 3 |
| Grammage | $g/m^2$ | 103 | 147 | 191 | 105 | 151 | 194 |
| Density | $kg/m^3$ | 464 | 468 | 520 | 496 | 537 | 553 |
| Tensile strength | kN/m | 4.08 | 5.92 | 7.59 | 4.95 | 7.04 | 9.12 |
| Tensile Stiffness | kN/m | 422 | 608 | 738 | 524 | 686 | 838 |
| Geom. Bending Resistance | mN | 14 | 47 | 83 | 16 | 39 | 76 |
| Bending Resistance Index | $Nm^6/kg^3$ | 11.8 | 13.9 | 11.0 | 13.0 | 10.2 | 9.9 |
| Z-Strength | kPa | 458 | 528 | 553 | 514 | 564 | 596 |
| Burst Strength | kPa | 283 | 439 | 608 | 354 | 507 | 708 |
| Bendtsen Porosity | ml/min | 712 | 175 | 85 | 136 | 140 | 51 |

TABLE 11d

| Paper Property | Unit | G1 | H1 | I1 | J1 |
|---|---|---|---|---|---|
| Grammage | $g/m^2$ | 155 | 148 | 150 | 154 |
| Density | $kg/m^3$ | 337 | 380 | 384 | 542 |
| Tensile strength | kN/m | 4.05 | 5.74 | 6.41 | 7.63 |
| Tensile Stiffness | kN/m | 411 | 551 | 582 | 724 |
| Geom. Bending Resistance | mN | 86 | 73 | 70 | 39 |
| Bending Resistance Index | $Nm^6/kg^3$ | 25.7 | 21.7 | 20.4 | 10.0 |
| Z-Strength | kPa | 298 | 465 | 532 | 603 |
| Burst Strength | kPa | 232 | 406 | 469 | 546 |
| Bendtsen Porosity | ml/min | 650 | 200 | 145 | 54 |

The invention claimed is:

1. A process of producing a cellulosic product comprising (i) providing an aqueous suspension of cellulosic fibers, (ii) adding microfibrillar polysaccharide, (iii) adding thermoplastic microspheres, (iv) dewatering the suspension and forming a cellulosic product, wherein the weight ratio of microfibrillar polysaccharide to thermoplastic microspheres ranges from about 1:100 to about 200:1, and wherein the final specific surface area, as determined by adsorption of $N_2$ at 177 K according to the BET method using a Micromeritics ASAP 2010 instrument, of the microfibrillar polysaccharide is from 3 to 10 $m^2/g$.

2. The process according to claim 1, wherein the microfibrillar polysaccharide is added in an amount from about 0.1 to about 50 wt % based on the weight of cellulosic product.

3. The process according to claim 1, wherein the microfibrillar polysaccharide is microfibrillar cellulose.

4. The process according to claim 3, wherein the microfibrillar cellulose is derived from hardwood and/or softwood.

5. The process according to claim 1, wherein the thermoplastic microspheres are added in an amount from about 0.01 to about 10 wt % based on the weight of cellulosic product.

6. The process according to claim 1, wherein the cellulosic product is paperboard.

7. The process according to claim 1, wherein the suspension comprises mechanical, recycled, and/or kraft pulp.

8. The process according to claim 1, wherein the cellulosic product is a single layer board.

9. The process according to claim 1, wherein microfibrillar polysaccharide and thermoplastic microspheres are added as a premix.

* * * * *